US005265384A

United States Patent [19]

Menke et al.

[11] Patent Number: 5,265,384

[45] Date of Patent: Nov. 30, 1993

[54] PRE-FABRICATED LIVING QUARTERS STRUCTURE TO BE RECEIVED WITHIN AN EXISTING BUILDING

[75] Inventors: Stephen A. Menke, Great Bend; Steven C. Moser; Charles L. Burton, both of Manhattan, all of Kans.

[73] Assignee: Mobile Care, Inc., Great Bend, Kans.

[21] Appl. No.: 868,469

[22] Filed: Apr. 14, 1992

[51] Int. Cl.[5] ..... E04H 1/12

[52] U.S. Cl. ..... 52/79.1; 52/79.8

[58] Field of Search ..... 296/21, 27; 52/79.1, 52/79.8

[56] References Cited

U.S. PATENT DOCUMENTS 4,499,696 2/1985 Freeauf ..... 52/79.8

*Primary Examiner*—James L. Ridgill, Jr.

*Attorney, Agent, or Firm*—Hovey, Williams, Timmons & Collins

[57] ABSTRACT

A prefabricated living quarters structure (10) adapted to be received within an existing building such as a garage (12) attached to an existing house (14), the structure being comprised of a plurality of wall panels (28) which are joined together to define the exterior walls of the structure (10), the structure having overall dimensions only slightly smaller than the building (12) within which it is received so that the structure (10) essentially fully occupies the space of the existing building (12) within which it is received; the structure being particularly intended for use by the handicapped and having full living facilities therein, such as a complete bathroom unit (30), the structure (10) having means placing the same in communication with the exterior thereof and also with the interior of a house (14) to which the garage (12) which receives the structure (10) is attached.

10 Claims, 4 Drawing Sheets

PRE-FABRICATED LIVING QUARTERS STRUCTURE TO BE RECEIVED WITHIN AN EXISTING BUILDING

BACKGROUND OF THE INVENTION

1. Field of the Invention

The invention relates to a pre-fabricated modular living quarters structure particularly intended for use by the handicapped, which structure is received within an existing building such as, for instance, the attached garage of a house.

2. Description of the Prior Art

While various types of pre-fabricated modular structures have heretofore been known, these have been essentially limited to free standing buildings intended to be positioned on their own and not within an existing structure or building. Such manufactured buildings usually take the form of walls fabricated from a plurality of panels which are suitably connected together to define the finished structure, there being a roof provided for the structure to complete the same in order that it may be positioned on a slab or foundation.

While such structures have been fabricated in a multitude of forms and configurations and various details of construction thereof have been known and utilized for some time, it is not believed that it has heretofore been contemplated that such a structure would be received within an existing building, such as the attached garage of a house, with the dimensions of the structure being only slightly smaller than that of the building within which it is received so that the entire interior space of the receiving building may be utilized by the pre-fabricated modular living quarters structure particularly intended for use by the handicapped.

SUMMARY OF THE INVENTION

The pre-fabricated living quarters structure hereinafter described is intended to present a health care suite which may be readily and rapidly erected within an existing building whereby a handicapped person may be provided with living facilities which are in communication with the exterior of the existing building within which the structure is received, but also in communication with the interior of the building, normally a house, which house is usually attached to the garage within which the structure is received.

The structure is provided with a human living support system with certain components thereof being independently operable and other components, such as sewage and water, for instance, adapted to be connected with comparable systems associated with the house which is attached to the garage within which the structure is received.

Thus there is presented a pre-fabricated living quarters structure which may be readily erected within either a single or double garage attached to a house which provides an area within which a handicapped person may readily function for a limited period of time until recovery, the structure being readily available due to its prefabrication and its modular components so that the entire living quarters may be erected within approximately 48 hours of its need.

Thus there is provided handicapped accessible modular room structure, provided with all modern conveniences and amenities which is specifically intended to be received within the attached garage of a house whereby the handicapped person may be housed in facilities which are attached to and convenient to the occupant of a house, it being assumed that such occupant would be a caretaker for the handicapped person by virtue of kinship.

DESCRIPTION OF THE PREFERRED EMBODIMENT

Figure 1:
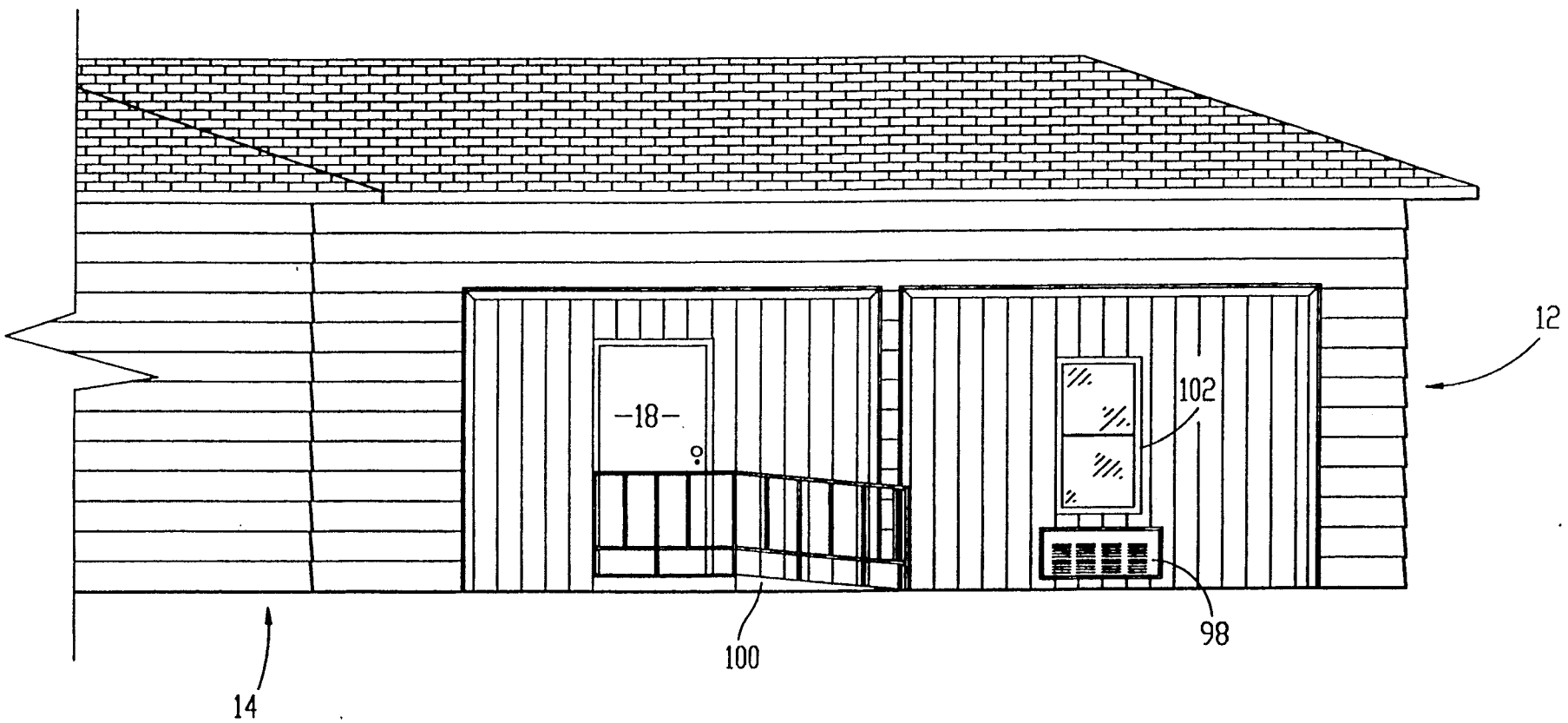
FIG. 1 is a fragmentary front elevational view of the garage within which the structure has been received showing the manner of ingress to the living quarters.

The handicapped accessible modular room structure, broadly designated by the numeral 10 is pre-fabricated, whereby it may be readily but closely received within an existing building, such as a garage 12 of a house 14, it being contemplated that the garage 12 will be attached to the house whereby communication may be provided between the house and the interior of the structure, as by means of an interior door 16, there being an exterior door 18 providing communication between the interior of the room structure 10 and the outside.

The room structure 10 is comprised of a normally front wall 20, a pair of parallel side walls 22 and 24, and a rear wall 26 normally parallel with the front wall 20.

Each of these walls is fabricated from a plurality of pre-fabricated wall panels 28 which will hereinafter be described in greater detail. A bathroom unit 30 is received within the room structure enclosure and provides the usual amenities thereof such as a tub 32, a stool 34, a lavatory 36 and suitable counter and storage space such as 38. A hot water heater 40 is provided for the bathroom unit 30 and the self-contained bathroom unit 30 is also provided with a sewage pump 41 for handling sewage generated from the stool 34. See FIGS. 3 and 7.

The tub 32 may be a whirlpool bathtub or a special handicapped accessible tub providing ease of ingress and egress for a handicapped person. Likewise, the stool 34 is elevated in height, making it handicapped accessible. If desired, the stool may be provided with an electric raising seat to provide assistance to the patient in coming to a standing position after use of the toilet. The counters and cabinets 38 are likewise handicapped accessible. The floor 42 of the bathroom unit is coated with a special non-skid rubberized material for safety purposes.

Since the entire room structure 10 and therefore the bathroom unit 30 are all especially intended to be received within the garage 12 attached to an existing house 14, it is important that the modular bathroom unit be of a size to move through the normal door of a garage. In order to accomplish this, the bathroom unit 30 is fabricated from a base or floor unit 42 on which the other components of the bathroom are positioned. The walls of the bathroom are assembled as a unit and in order to conserve space and provide ease of access for a handicapped person the normally front wall 44 of the bathroom unit is provided with a pocket door 46.

Figure 6:
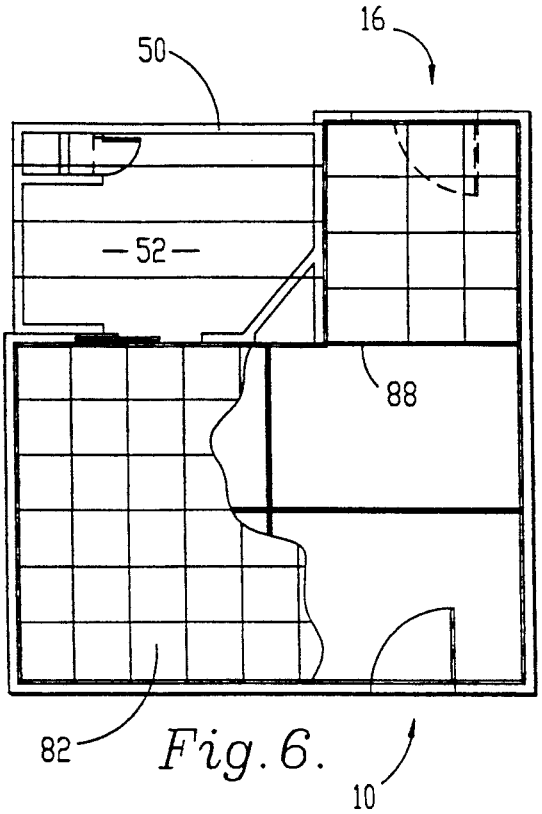
FIG. 6 is a plan view of the structure received within a double garage with portions of the ceiling being broken away to show details of construction.
Figure 3:
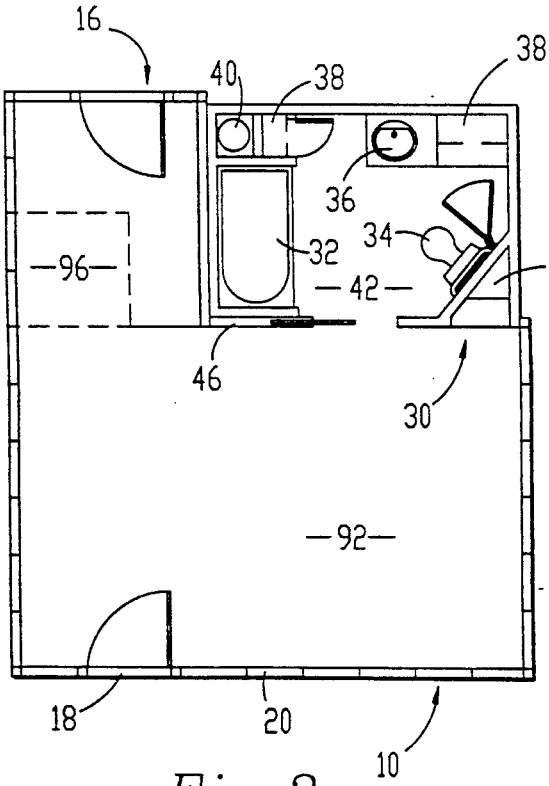
FIG. 3 is a plan view of the structure showing the bathroom in one possible position within the room.
Figure 4:
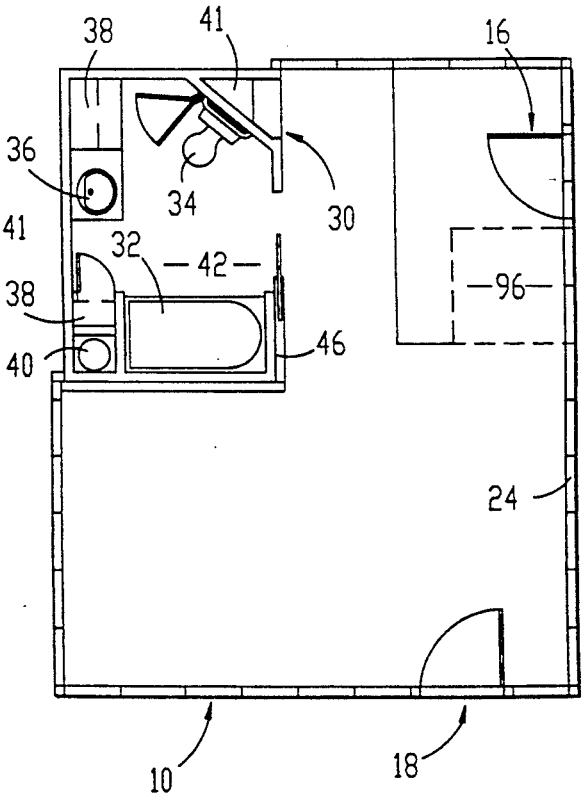
FIG. 4 is a plan view of the structure showing the bathroom in another possible position within the room.

It is contemplated that the entire bathroom unit, consisting of the base or floor 42 and the outer walls thereof, will be erected at a remote location and then moved as a unit through the garage door and into the desired position within the garage, it being noted from FIGS. 3, 4 and 6, for instance, that the bathroom may be located in different positions within the room structure, depending upon whether a single garage is utilized or whether the room structure 10 is placed within a double garage. Thus, for instance, FIG. 3 shows the bathroom unit 30 positioned across the back of a double garage, with the pocket door 46 being generally parallel with the front wall 20 of the room structure. On the other hand, FIG. 4 shows the bathroom unit 30 positioned within a double garage with the pocket door 46 in parallel relationship to a side wall 24 of the room structure.

Figure 5:
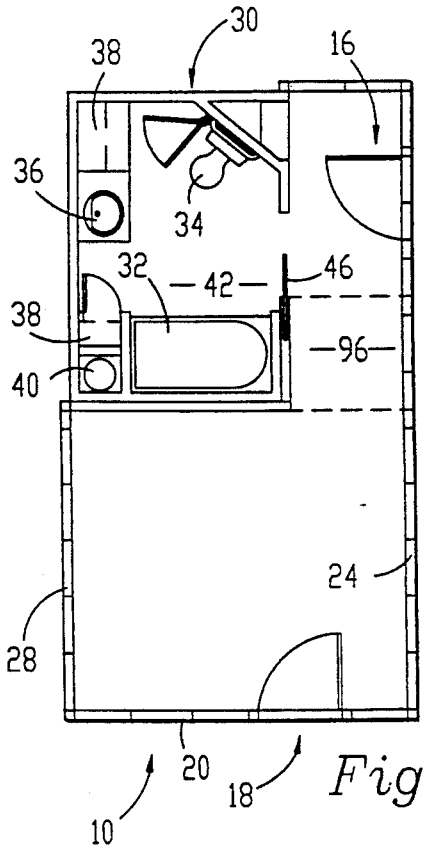
FIG. 5 is a plan view showing the structure received within a single garage.

FIG. 5 illustrates the bathroom unit 30 positioned within a single garage with the pocket door 46 being parallel to a side wall 24 of the room structure.

Thus, given the pre-fabrication of the bathroom unit 30 and its moveability, as by casters or otherwise, together with the fact that it may be moved through a garage door, it may be positioned at any desired location within the garage and the other walls of the room structure then erected to accommodate the bathroom unit 30. It will be appreciated that it is important that the bathroom unit be positioned, if at all possible, adjacent a common wall between the garage 12 and the house 14, inasmuch as the plumbing for the bathroom unit is normally connected with that of the house 14 and thus access to the house plumbing is important.

Likewise, it is contemplated that the sewage pump 41 will deliver sewage from the bathroom unit to the sewage disposal system of the house 14 and thus, here again proximity to the wall of the house 14 would be important.

In order to utilize the sewage pump 41, two holding tanks (not shown) form a part of the bathroom unit, one receiving water flowing out of the tub and the other accommodating waste from the toilet and lavatory. These tanks are provided with suitable sensing devices so that when the contents thereof reach a certain level the pump 41 will be activated to eject the waste water and discharge it into the sewage system of the house, with which the pump 41 is connected by suitable flexible piping. The holding tanks utilized for the bathroom and to hold the sewage water are preferably positioned within the confines of the bathroom unit above the floor 42 thereof, this permitting the entire bathroom unit 30 to be positioned within a garage, as hereinabove described, without requiring a crawl space underneath the bathroom or the excavation of concrete or dirt below the bathroom to accommodate the sewage holding tanks or, for that matter, other plumbing.

Thus it will be appreciated that when the bathroom unit is initially positioned the sewage line therefrom is run through the wall of the house 14 and connected with the sewage discharge system normally provided in the house.

Likewise, the hot water heater and other water supply facilities of the bathroom unit 30 are coupled with the regular plumbing provided for house 14 by flexible piping or the like. This provides a flow of water to the bathroom unit 30 whereby the same may be utilized in the usual fashion.

Given the reduced size of the bathroom unit 30 in order to permit placement thereof in the garage, there is provided a cap 48 for the bathroom unit 30 which is placed atop the walls 44 and 50 which define the bathroom, the cap consisting of a plurality of ceiling panels 52, as best shown in FIG. 6 of the drawing. Casters 54 adjacent the base or floor 42 of the bathroom unit 30 may be utilized to initially wheel the bathroom unit 30 into place within the garage 12.

Figures 7, 8, 9, 10, 11, 12, 13, 14, 15, 16:
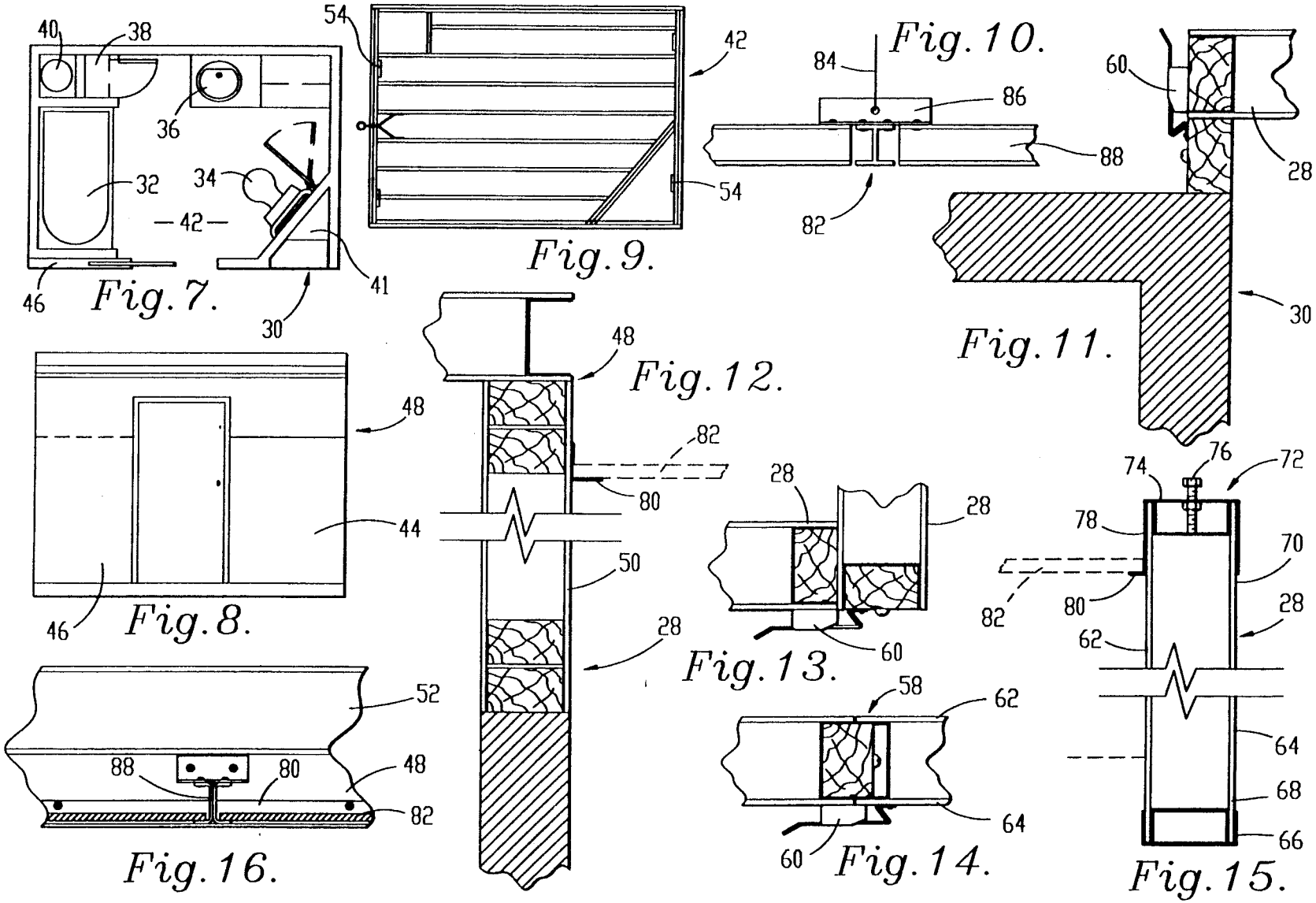
FIG. 7 is a plan view of the bathroom unit with the ceiling removed.
FIG. 8 is a front elevational view of the bathroom unit showing the pocket door therefor.
FIG. 9 is a top plan view of the bathroom unit with the ceiling panels in place.
FIG. 10 is a fragmentary view of the ceiling structure showing the means of suspension of the ceiling.
FIG. 11 is a fragmentary view of a vertical joint at one corner of the bathroom unit.
FIG. 12 is a vertical cross sectional view of the bathroom wall.
FIG. 13 is a plan view of a wall corner showing two panels latched together.
FIG. 14 is a plan view of a side wall structure showing two units latched together.
FIG. 15 is an elevational view of one of the wall panels utilized to fabricate the handicapped accessible modular room structure.
FIG. 16 is a fragmentary elevational view partially in section showing the ceiling grid as secured to the exterior of the bathroom wall.

The cap 48 consists of vertical members 56 which circumscribe the upper edge of the wall panels 44 and 50 which define the bathroom, the vertical members supporting the ceiling panels 52, again as illustrated as FIG. 12 of the drawing.

The walls of the room structure 10 are, as indicated, comprised of a plurality of wall panels 28 which are particularly designed for a rapid set up. Each of the wall panels 28 is preferably two feet wide and eight feet, six inches tall and are provided with tongue and groove locking arrangements 58, as best shown in FIG. 14, there being a latch assembly 60 on the exterior face of the walls 28 whereby to secure the upstanding wall panels 28 in tight abutting relationship, as illustrated. Each of the panels 28 preferably is provided with a foam strip on its inside edge to provide a tight fit between the panels, this fit being further enhanced by the utilization of the latch assembly 60 in securing the walls together.

It is contemplated that the interior face 62 of the wall panels 28, as illustrated in FIGS. 14 and 15, for instance, will be covered with a suitable vinyl or other decorative wall covering. On the other hand, the exterior face 64 of the wall panels is coated with a fire resistance material. The panels are filled with a fire resistant insulation material. Yet further, and in order to ensure the fire safety of the entire unit, a system of sprinkler heads (not shown) are strategically located within the bathroom unit 30 to react in case of fire. As a further means of defense against fire, a plurality of smoke detectors may be positioned throughout the unit and connected to an automatic dialer to contact the fire department and/or rescue squad in case of a fire within the unit 10.

In order to permit ready assembly of the wall panels 28 into the finished room structure 10, a base track 66 is provided, as shown in FIG. 15, each of the panels having its lower end 68 received within the channel or track 66, as illustrated. The upper end 70 of each of the panels is provided with ceiling support structure 72, as best illustrated in FIG. 15, which structure is designed to eliminate the necessity of multiple wires to support the suspended ceiling. Thus, there is provided a fixture 74 which seats within the upper ends 70 of each of the wall panels and has an adjusting screw 76 as part thereof, the screw serving to adjust and level an angle member 78 which extends downwardly from the upper end 70 of the wall panel 28 along the interior face 62 of the wall panel and presents an inwardly extending flange 80 which in turn supports the ceiling system, which consists of multiple large panels which have been previously secured together and may therefore be readily placed within the confines of the wall panels 28 making up the room structure 10 to thereby define the ceiling for the room structure, except the bathroom unit, this ceiling structure being indicated at 82.

FIG. 10 illustrates the manner in which the ceiling structure 82 is supported by a single suspension cable 84, which cooperates with the continuous flange 80 to retain the ceiling structure in its desired position. Thus, the outer edges of the ceiling structure are continuously supported by the flanges 80 and the center is supported by the suspension cable 84 which is attached to a connector 86 which in turn supports the ceiling grid 88.

Figure 2:
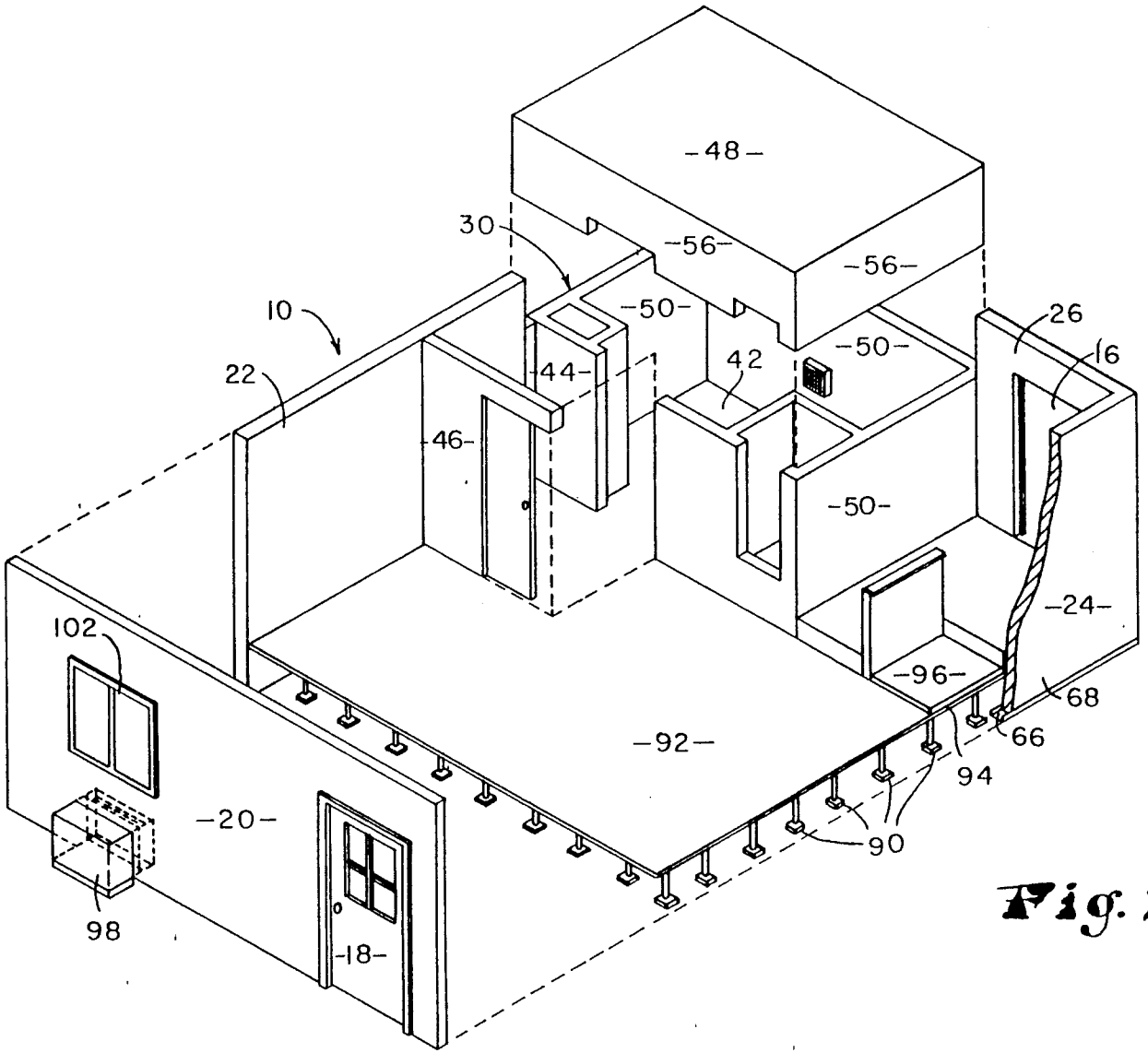
FIG. 2 is an exploded perspective view of the handicapped accessible modular room structure with portions broken away to depict the pre-fabricated components thereof in their position of assembly.

The floor system for the room structure is elevated, as shown in FIG. 2, and consists of a plurality of pedestals 90 supporting a horizontal floor 92, which extends throughout the room structure, except for the bathroom unit 30, wherein a separate pre-fabricated floor or base 42 is provided. It will be appreciated that the space beneath the floor may be utilized for plumbing or electrical installations and that the pedestals 90 may be in the form of jacks or rams or the like capable of adjustment to ensure that the floor 92 is level. As shown in FIG. 2, the track 66 which supports the wall panels 28 is arranged around the periphery of the floor 92 so that when the panels 28 are erected in their vertical position, the interior faces 62 thereof will normally about a peripheral edge 94 of the floor.

When erecting the room structure, it will be appreciated that the pocket door may be a part of the bathroom unit 30 or that it may be fabricated separately, such as shown in FIG. 2, whereby once the bathroom unit 30 is installed in the desired position in the garage, the pocket door may then be suitably secured to the normally front wall of the bathroom unit 30 to cover the opening which has been provided therein. Once the bathroom unit has been installed within the garage, the cap 48 is placed thereon.

The level or height of floor 92 is normally below that of the floor of the house 14 to which the garage 12 is attached and, therefore, in order to accommodate a handicapped person and permit movement of a wheelchair, for instance, from the level of floor 92 to the level of the floor of the house 14, a suitable lift 96 is provided; whereby the person utilizing the room structure 10 may move their wheelchair into the lift 96 and be raised up to the level of door 16 to thereby gain access to the house 14. It will be appreciated that lift 96 might be replaced by a suitable ramp, all to the end that a handicapped person may readily move between the interior of the room structure 10 and into the house 14.

To particularly permit the accommodation of the room structure 10 to the house 14, there are provided separate panels which have the door 16 therein, these panels having adjustable legs on the bottom thereof to allow adjustment of the door provided for room structure 10 to accommodate the corresponding door of the house 14.

The room structure 10 may be independently heated and/or cooled by a unit 98 normally positioned in the front wall 20 of the room structure, for ventilation purposes, and wired into the electrical system of the house 14.

In this regard, it will be appreciated that a separate electrical system and meter may be provided for the room structure 10 or, in the alternative, it may be wired into the existing electrical system of the house 14 which is attached to the garage 12 within which the structure is positioned.

Once the room structure has been positioned within the garage, it is desirable to provide an entry ramp 100 leading to the entry door 18 to facilitate access by the handicapped person. The front wall 20 of the room structure 10 may be paneled, shingled or otherwise covered, as illustrated in FIG. 1, whereby to aesthetically accommodate the room structure to the overall exterior appearance of the garage 12 and house 14. Normally, a window 102 would be provided in the front wall 20 of the room structure so that some natural light could enter the interior of the room structure.

It is contemplated that the individual components and elements of the room structure 10 would be prefabricated at a remote location and that when a person had need for the room structure 10 they would call a supplier who would bring the individual pre-fabricated components to the home of the care giver and erect these components within either the single or double garage attached to the house of the care giver, thereby to readily and rapidly provide living quarters for the handicapped person by means of the modular room structure which is very accessible to handicapped persons.

A unique transportation system has been developed to handle the movement of room structure 10 to and into the garage 12 of house 14. A tilt bed trailer is provided to deliver the bathroom, as well as other large components of the room structure 10, the trailer being equipped with tracks which allow the bathroom module to be off-loaded and to then be moved, on casters provided at the bottom thereof, to its desired position within the garage 12, as illustrated in the drawings and referred to hereinabove. Likewise, the other components of the room structure may be readily removed from a transporting truck or similar vehicle and set up within the garage without the necessity of utilizing special heavy equipment such as a forklift or a crane, since all of the components making up the floor and walls of the unit can be managed and handled by one or two men and positioned without undue effort.

It will be appreciated further, however, that such room structure might be utilized to merely provide an extra room for a house for housing a non-handicapped person, and that such room would be provided with all of the conveniences and facilities hereinabove described. To facilitate placement of the room structure 10 within the garage 12, caster wheels may be provided so that the unit may be wheeled into place and then secured in a final position. Likewise, hooks and lifting means may be provided to facilitate handling of the pre-fabricated structural components which are utilized to create the room structure 10 hereinabove described in detail.

We claim:

1. Pre-fabricated living quarters structure comprising:

an existing building for receiving the living quarters structure therewithin, said existing building being in the form of a house having an electrical system, a plumbing system, a sewage system and a garage, the pre-fabricated structure normally being erected and received within the garage;

a plurality of wall panels joined together to define the exterior walls of the structure, said structure having overall dimensions only slightly smaller than that of the garage within which it is received so that the structure essentially fully occupies the space of the garage within which it is received;

means placing said structure in communication with the exterior of the structure; and a human living support system within said structure, including electrical components, plumbing components and sewage components, the plumbing and sewage components of said human living support system being adapted to be connected with comparable systems associated with the existing, receiving house.

2. A pre-fabricated, living quarters structure as described in claim 1, wherein said structure is defined by a plurality of vertical, interconnected wall panels, said panels being generally parallel with and spaced inwardly from the walls of the garage.

3. A pre-fabricated, living quarters structure as described in claim 2, wherein said walls support a ceiling for said structure, said ceiling being spaced downwardly from the ceiling of the garage.

4. A pre-fabricated, living quarters structure as described in claim 3, there being a modular bathroom within said structure.

5. A pre-fabricated, living quarters structure as described in claim 4, said bathroom having vertical walls defining the same, said walls being of a height to permit the modular bathroom to be moved through a garage door as a unit.

6. A pre-fabricated, living quarters structure as described in claim 5, there being a cap supported by said bathroom walls to form a ceiling for the bathroom.

7. A pre-fabricated, living quarters structure as described in claim 6, the bathroom having a pocket door therein to provide access to the bathroom.

8. A pre-fabricated, living quarters structure as described in claim 7, there being a door placing said structure in communication with the house to which the garage receiving the structure is attached.

9. A pre-fabricated, living quarters structure as described in claim 8, there being means within the structure to accommodate any difference in height between the floor of the structure and the floor of the house through said door to permit movement of a person in a wheelchair from the structure and into the house.

10. A pre-fabricated, living quarters structure as described in claim 9, the floor of the structure being spaced above the floor of the garage.

* * * * *